US009534480B2

(12) United States Patent
Hendryx

(10) Patent No.: US 9,534,480 B2
(45) Date of Patent: Jan. 3, 2017

(54) PRESSURE COMPENSATION FOR A BACKUP WELL PUMP

(71) Applicant: Baker Hughes Incorporated, Houston, TX (US)

(72) Inventor: Thomas N. Hendryx, Victoria, TX (US)

(73) Assignee: Baker Hughes Incorporated, Houston, TX (US)

( * ) Notice: Subject to any disclaimer, the term of this patent is extended or adjusted under 35 U.S.C. 154(b) by 463 days.

(21) Appl. No.: 14/062,469

(22) Filed: Oct. 24, 2013

(65) Prior Publication Data

US 2015/0114662 A1 Apr. 30, 2015

(51) Int. Cl.

| | |
|---|---|
| ***E21B 43/12*** | (2006.01) |
| ***F04D 13/10*** | (2006.01) |
| ***F04D 13/12*** | (2006.01) |
| ***F04D 29/08*** | (2006.01) |

(52) U.S. Cl.

CPC ..... *E21B 43/126* (2013.01); *E21B 43/128* (2013.01); *F04D 13/10* (2013.01); *F04D 13/12* (2013.01); *F04D 29/086* (2013.01)

(58) Field of Classification Search

CPC ..... E21B 43/128; E21B 43/126; F04D 13/08; F04D 13/83; F04D 13/16; F04B 47/06; H02K 5/132; H02K 2205/09

See application file for complete search history.

(56) References Cited

U.S. PATENT DOCUMENTS

| | | | | |
|---|---|---|---|---|
| 3,947,709 | A * | 3/1976 | Waltman | H02K 5/132 310/87 |
| 4,558,246 | A | 12/1985 | Tokumitsu | |
| 6,851,935 | B2 | 2/2005 | Merrill et al. | |
| 7,431,093 | B2 | 10/2008 | Bearden et al. | |
| 2006/0207759 | A1* | 9/2006 | Bearden | E21B 43/128 166/105 |
| 2011/0017468 | A1* | 1/2011 | Birch | E21B 17/026 166/369 |
| 2013/0004344 | A1* | 1/2013 | McKinney | E21B 43/128 417/366 |

* cited by examiner

*Primary Examiner* — Robert E Fuller
*Assistant Examiner* — Steven MacDonald
(74) *Attorney, Agent, or Firm* — Bracewell LLP; James E. Bradley

(57) ABSTRACT

Primary and secondary pump assemblies are mounted to and supported by a supporting device in a well. The supporting device has a valve that has a first position allowing flow from the primary pump assembly while the secondary pump assembly is in a storage mode, and a second position allowing flow from the secondary pump assembly. A barrier in the intake of the secondary pump assembly blocks entry of well fluid into the secondary pump assembly while the valve is in the first position. The secondary pump is filled with a buffer fluid. A pressure compensator mounted to the secondary pump assembly has a movable element that moves in response to a difference between well fluid pressure on an exterior of the secondary pump assembly and the pressure of the buffer fluid contained in the secondary pump to reduce a pressure differential.

6 Claims, 5 Drawing Sheets

PRESSURE COMPENSATION FOR A BACKUP WELL PUMP

FIELD OF THE DISCLOSURE

This invention relates in general to electrical submersible well pump assemblies and in particular to a pressure compensator for a backup pump assembly installed within a well.

BACKGROUND

Electrical submersible pump assemblies are commonly used in hydrocarbon producing wells to pump well fluid. These assemblies include a rotary pump driven by an electrical motor. A seal section coupled between the pump and motor reduces a pressure differential between well fluid and motor oil or lubricant contained in the motor and part of the seal section. Usually, a string of production tubing supports the submersible pump assembly in the well. A drive shaft extends from the motor through the seal section to the pump.

U.S. Pat. No. 7,431,093 discloses a system employing primary and secondary pumps suspended in a well by a supporting device. The secondary pump is filled with a buffer fluid that is sealed by temporary barriers in the intake ports. The operator runs the primary pump while the secondary pump remains in the stored, non operating mode. Eventually, the primary pump fails, or for other reasons, the operator shuts down the primary pump in order to begin using the secondary pump. The operator uses various techniques to open the temporary barriers and expel the buffer fluid, then supplies power to run the secondary pump.

The secondary pump may be in the stored mode for quite a long time. There is a risk that the barriers and other seals leak, admitting well fluid into the secondary pump, as well as into contact with the motor oil of the secondary motor. The well fluid may be corrosive and cause damage to the pump stages. The well fluid would also damage the internal components of the motor.

SUMMARY

In this disclosure, a primary pump assembly and a secondary pump assembly are operatively coupled to each other. The secondary pump assembly has a storage mode while the primary pump operates and an operational mode while the primary pump is not operating. A buffer fluid is sealed within the secondary pump assembly while the secondary pump assembly is in the storage mode. A pressure compensator is mounted to the secondary pump assembly. The pressure compensator has a movable element that moves in response to a difference in pressure between well fluid on an exterior of the secondary pump assembly and buffer fluid within the secondary pump assembly to reduce a pressure differential between the well fluid and the buffer fluid.

The pressure compensator may have a wall structure having an inner side, an outer side, and a well fluid entry port to admit fluid to the inner side. The movable element has an inner side in contact with the buffer fluid and an outer side for contact with well fluid entering through the entry port. The movable element seals the buffer fluid from contact with the well fluid.

The wall structure may be an annular wall. The movable element may be a flexible sleeve surrounded by the annular wall. Preferably, the pressure compensator is mounted below the intake of the pump of the secondary pump assembly.

The pressure compensator may also include a capsule enclosing the secondary well pump assembly. The capsule as well as the pump of the secondary well pump assembly are filled with the buffer fluid. The capsule has a well fluid entry port. A flexible sleeve located within the capsule has an interior in fluid communication with the well fluid entry port. The flexible sleeve seals the buffer fluid in the capsule from the well fluid contained in the interior of the flexible sleeve.

A sensor may be mounted in the secondary pump assembly in fluid communication with the buffer fluid. The sensor senses any well fluid contamination within the buffer fluid.

The secondary pump assembly may have a seal section coupled between a pump and a motor. The seal section has a flexible element that reduces a pressure differential between the well fluid and motor lubricant in the motor. The pressure compensator for the buffer fluid is mounted between above the flexible element of the seal section and below the pump.

DETAILED DESCRIPTION OF THE DISCLOSURE

Figure 1:
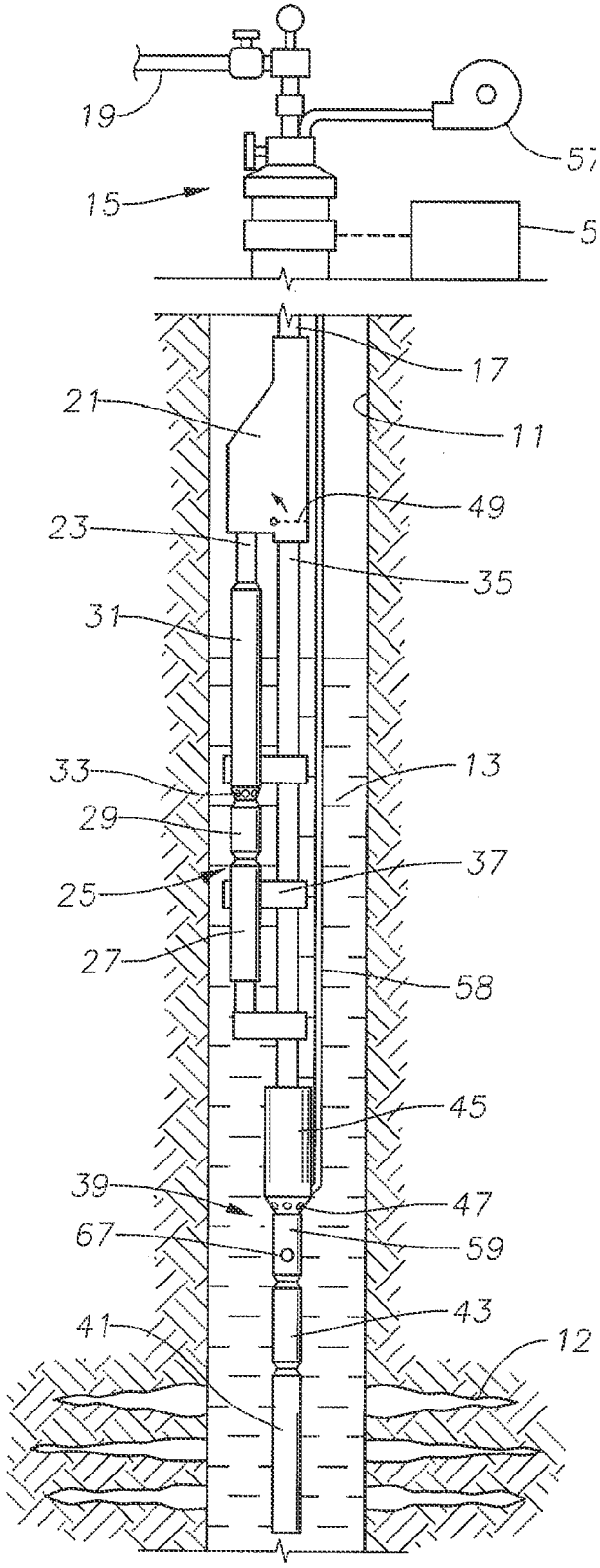
FIG. 1 is a side view of well pumping equipment in accordance with this disclosure and suspended in a well.

Referring to FIG. 1, a cased well 11 has a conventional production tree 15 at its upper end. Cased well 11 has perforations 12 or other means for admitting well fluid 13. A string of production tubing 17 is suspended by tree 15 and extends into well 11. Tubing 17 may be sections of tubing with threaded ends secured together, or it may comprise continuous coiled tubing. Well fluid produced up tubing 17 discharges out a flow line 19 connected to production tree 15.

A supporting device 21 secures to tubing 17 and supports well pumping equipment. In this example, supporting device 21 is a Y-tool having a first tubular inlet 23 to which the discharge of a primary or first submersible pump assembly 25 connects. Primary pump assembly 25 may be conventional, having a motor 27, typically a three-phase electrical motor. A seal section 29 connects between motor 27 and a pump 31. Seal section 29 has a movable element to reduce a pressure differential between well fluid 13 surrounding motor 27 and motor oil contained in motor 27. Pump 31 has an intake for drawing well fluid 13 in and pumping the well fluid up tubing 17. Pump 31 is preferably a rotary pump such as a centrifugal pump with a large number of stages, each stage having an impeller and diffuser. Alternately, pump 31 may be a progressive cavity pump. Primary pump assembly 25 may include other components, such as a gas separator.

Supporting device 21 has a second inlet 35 offset form first inlet 23. A secondary submersible pump assembly 39 secures to second inlet 35 and extends parallel but lower than primary pump assembly 25 in this illustration. Secondary pump assembly 39 has a motor 41, normally a three-phase electrical motor. A seal section 43 connects to an upper end of motor 41. Secondary pump 45 is also preferably a rotary pump, either a centrifugal or progressive cavity type. Secondary pump 45 has intake ports 47 to draw well fluid in and pump the well fluid up tubing 17.

Secondary pump assembly 39 serves as a back up to be used after primary pump assembly 25 fails or is shut down for other reasons. Secondary pump assembly 39 is stored within well 11 in a non operating mode while primary pump assembly 25 operates. A valve 49 located in supporting device 21 closes off the upper end of secondary pump assembly 39 while it is in the storage mode. When secondary pump assembly 39 is in an operating mode, valve 49 opens secondary inlet 35 and closes primary inlet 23. Valve 49 may be a flapper valve, a sliding sleeve, or other types. A controller 51 adjacent to production tree 15 supplies electrical power over a power cable (not shown) leading to primary pump assembly 25. When it is decided to cease operating primary pump assembly 25, controller 51 supplies electrical power over another power cable to secondary pump assembly 39. Alternative devices to support primary pump assembly 25 and secondary pump assembly 39, other than supporting device 21, are feasible, such as a shroud as shown in U.S. Pat. No. 7,048,057.

Figure 2:
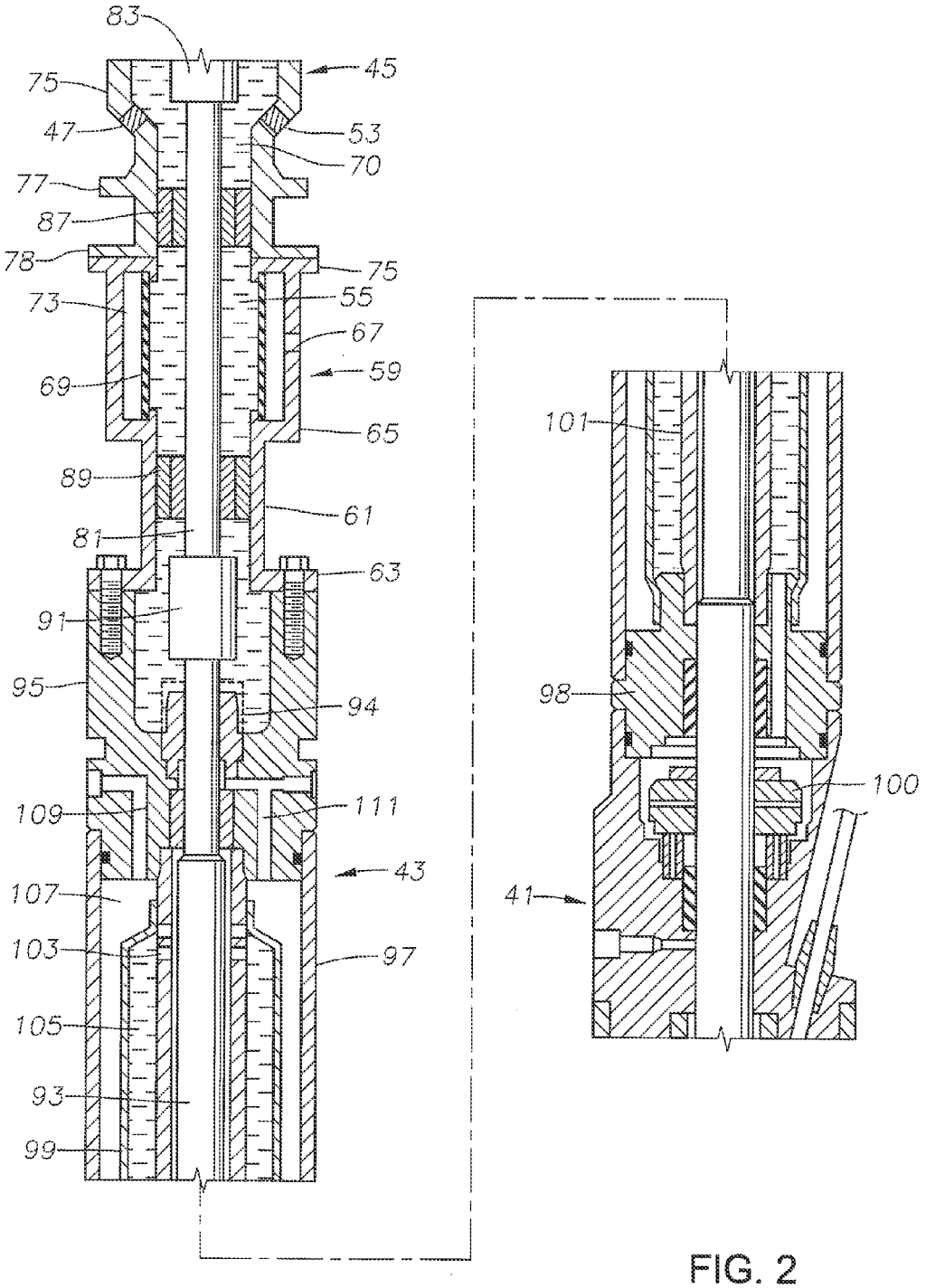
FIG. 2 is a sectional view of a seal section and buffer fluid pressure compensator of a secondary pump assembly of FIG. 1.

Well fluid 13 may be corrosive, thus could damage components within secondary pump 45 while it is in the non operating mode, which could be years. Referring to FIG. 2, temporary barriers or plugs 53 are installed in intake ports 47, and a buffer fluid 55 dispensed within secondary pump 45. Flapper valve 49 seals buffer fluid 55 at the upper end of secondary pump 45. Barriers 53 and flapper valve 49 prevent well fluid 13 from being inside secondary pump 39 until it is placed in operation. Barrier plugs 53 could be other closure members, as explained in U.S. Pat. No. 7,048,057. Buffer fluid 55 is a fluid that is not corrosive for components of secondary pump 45, such as diesel.

Barriers 53 may be removed in various ways, as explained in U.S. Pat. No. 7,048,057, such as by increasing the pressure of the buffer fluid 55 over the pressure of well fluid 13 surrounding barriers 53 a sufficient amount to expel them. As illustrated in FIG. 1, one way to increase the buffer fluid pressure over the well fluid pressure uses a liquid or hydraulic fluid pump 57 adjacent to production tree 15. A delivery tube 58 extends from hydraulic fluid pump 57 to secondary pump 45 to deliver buffer fluid 55 or another liquid to the interior of secondary pump 45. Delivery tube 58 extends alongside tubing 17.

Secondary pump assembly 39 includes a pressure compensator 59 to reduce a pressure differential between well fluid 13 surrounding secondary pump assembly 39 and buffer fluid 55. If the pressure differential is low or zero, leakage of well fluid 13 into contamination with buffer fluid 55 is less likely to occur. Pressure compensator 59 is shown mounted between seal section 43 and pump 45, but it could be mounted elsewhere.

Referring again to FIG. 2, pressure compensator 59 has a tubular housing 61 that connects to an upper end of seal section 43, such as by bolts extending through holes in a lower bolt flange 63. Housing 61 has an annular wall 65 that may be cylindrical and which has a well fluid entry port 67. A movable compensating element, such as a flexible sleeve 69 is surrounded by cylindrical wall 65. Housing 61 has annular hubs 71 at the upper and lower ends of housing 61. Hubs 71 defined radially outward-facing cylindrical surfaces. The upper and lower ends of sleeve 69 slide over and are secured to the cylindrical surfaces of hubs 71. The sealing engagement of sleeve 69 to hubs 71 defines an outer chamber 73 between sleeve 69 and housing annular wall 65 that fills with well fluid 13 entering through well fluid entry port 67. Sleeve 69 blocks well fluid 13 from contact with buffer fluid 55 contained in a buffer fluid chamber 70 in secondary pump 45.

Other types of movable elements to equalize pressure are feasible. For example, rather than being an annular sleeve, the flexible element of pressure compensator 59 could be a diaphragm attached directly to the inner surface of housing annular wall 65 over well fluid entry port 67. Further, flexible sleeve 69 could be a metal bellows, generally as shown in the second embodiment in FIG. 5. Additionally, flexible sleeve 69 could be an elastomeric bag.

Figure 3:
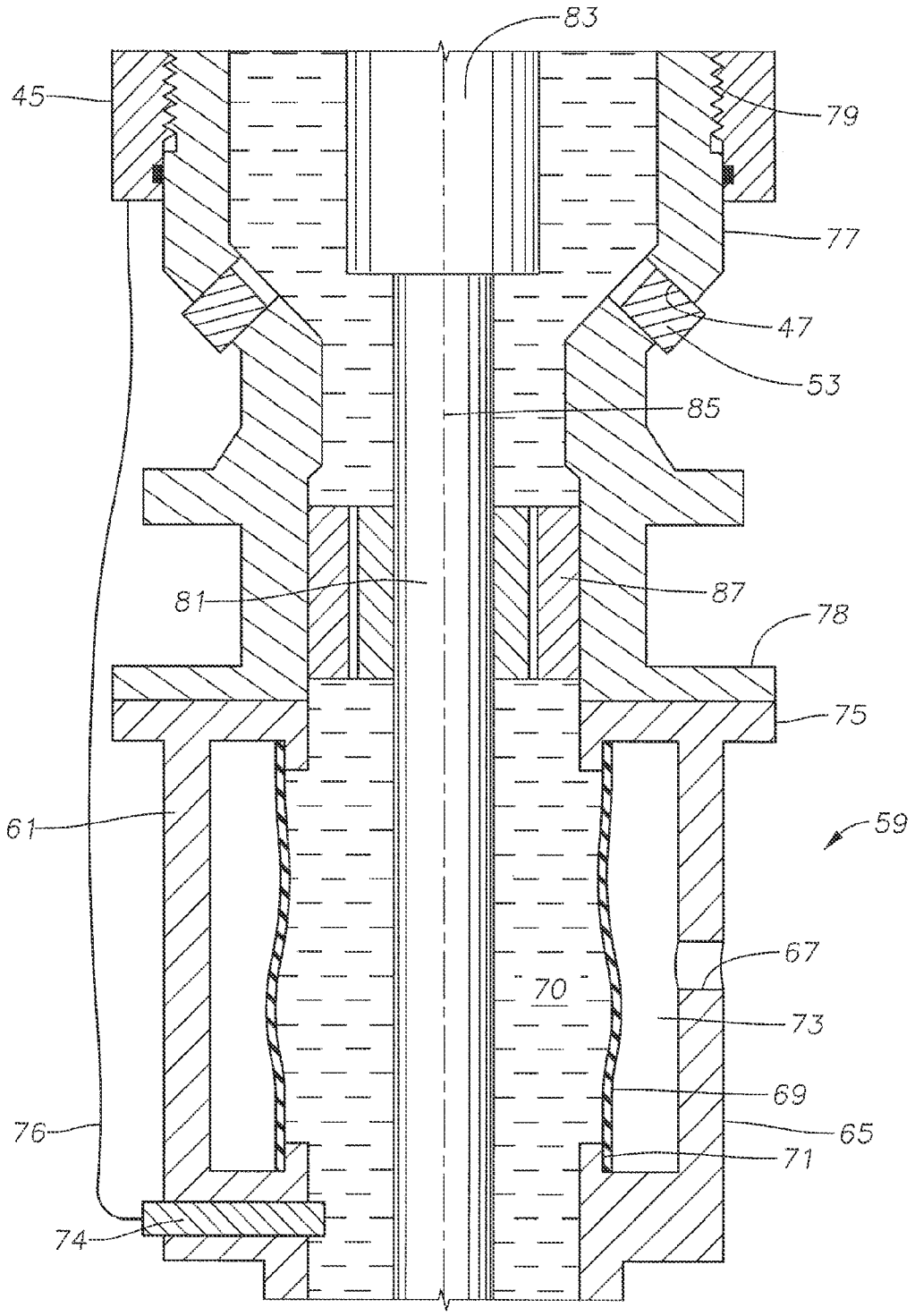
FIG. 3 is a further enlarged sectional view of the buffer fluid pressure compensator of FIG. 2.

Referring to FIG. 3, optionally, a sensor 74 mounts to pressure compensator housing 61 and has a sensing end in fluid communication with buffer fluid 55 in buffer fluid chamber 70. Sensor 74 connects to controller 51 (FIG. 1) via an instrument line 76, which may be a fiber optic line or an electrical line. Sensor 74 may be a variety of types for detecting encroachment of well fluid 13, which typically contains a large amount of water. For example, sensor 74 may be an opacity sensor, fluid density sensor, conductivity sensor, ph sensor, absorption spectroscopy sensor, opacity sensor, fluorescent fiber sensor, fiber optic sensor, or any other sensor suitable for detecting well fluid 13 in buffer fluid 55. Sensor 74 may be electronically powered or receive light from instrument line 76 leading to controller 51.

As another example, one suitable fiber optic sensor operates on a principle of total internal reflection. Light propagated down the fiber core hits an angled end of the fiber. Light is reflected based on the index of refraction of buffer fluid 55. The index of refraction varies in response to whether buffer fluid 55 contains water.

Another type of fiber optic sensor employs fluorescent material on the probe. The fluorescent signal is captured by the same fiber and directed back to an output demodulator. The returning signal can be proportional to viscosity and water droplet content. Well fluid 13 normally would have a different viscosity than buffer fluid 55, thus a measurement of viscosity correlates to well fluid encroachment in buffer fluid 55.

Referring again to FIG. 2, pressure compensator housing 61 may be coupled between seal section 43 and pump 45 a variety of ways. In this example, pressure compensator housing 61 has an upper bolt flange 75 that secures to a mating bolt flange 78 on a lower end of an intake housing 77. Alternately, intake housing 77 and pressure compensator housing 61 could be formed as an integral, single piece member. The upper end 79 of intake housing 77 is illustrated as being externally threaded and in engagement with threads in the bore of a housing of secondary pump 45. Alternatively, a bolt flange could be employed.

Pressure compensator 59 has a shaft 81 with a splined upper end that connects via a spline coupling 83 to a pump shaft within secondary pump 45. Shaft 81 is located on an axis 83 of secondary pump assembly 39. An upper bearing 87 is illustrated as mounting in intake housing 77 above flexible sleeve 69. Upper bearing 87 receives and provides radial support for pressure compensator shaft 81. Alternatively, upper bearing 87 could be within pressure compensator housing 61. A lower bearing 89 mounts in pressure compensator housing 61 below flexible sleeve 69. Lower bearing 89 also provides radial support for pressure compensator shaft 81. Upper and lower bearings 87, 89 do not form seals, thus buffer fluid 55 is free to communicate above and below upper and lower bearings 87, 89.

The lower end of pressure compensator shaft 81 is splined and connects to a shaft 93 extending through seal section 43. Shaft 93 is illustrated as being a single, continuous shaft extending from motor 41 upward through seal section 43; alternatively, shaft 93 could be a separate shaft of seal section 43 connected to a separate motor shaft. A shaft seal 94 at the upper end of seal section 43 seals around shaft 93 and is typically a mechanical face seal. Shaft seal 94 defines the lower end of buffer fluid chamber 70, thus is immersed in buffer fluid 55.

Seal section 43 has an upper adapter 95 that secures by threads to a seal section housing 97. Lower bolt flange 63 of pressure compensator housing 61 mates with a bolt pattern formed in upper adapter 95 to secure pressure compensator 59 to seal section 43. Alternatively, pressure compensator housing 61 could be integrally formed with seal section upper adapter 95. In this example, seal section 43 has a lower adapter 98 with upper threads that connect to the lower end of seal section housing 97. Lower adapter 98 has lower threads that connect to internal threads in the upper end of motor 41. As an alternate to lower adapter 98, a bolt flange arrangement may be used.

A thrust bearing 100 is shown located in the upper end of motor 41 for transmitting down thrust imposed on shaft 93 to the upper end of motor 41. Alternatively, thrust bearing 100 could be located in seal section 43 or in a separate housing.

Seal section 43 may be conventional. In this example, a movable element such as a bladder 99 is mounted in seal section housing 97. Bladder 99 may be elastomeric or a metal bellows. Shaft 93 extends through a guide tube 101, which in turn is located inside bladder 99. Guide tube 101 has a guide tube port 103 at its upper end to communicate motor oil 105 from motor 41 to the interior of bladder 99. Bladder 99 separates motor oil 105 in its interior from well fluid 13 located within a well fluid chamber 107 in seal section housing 97. Seal section 43 has a conventional port 109 that admits well fluid 13 to well fluid chamber 107. A conventional port 111 with a check valve allows motor oil 105 to be expelled into well fluid chamber 107 in the event motor oil 105 reaches a selected pressure over the pressure of well fluid 13 in well fluid chamber 107 due to thermal expansion.

In the operation of the embodiment of FIGS. 1-3, primary and secondary pump assemblies 25, 39 are secured to supporting device 21 and lowered into well 11. Secondary pump assembly 39 will contain buffer fluid 55 that is sealed in buffer fluid chamber 70 from well fluid 13 by intake barriers 53, compensator flexible sleeve 69, seal section shaft seal 94 and valve 49 in supporting device 21. As primary and secondary pump assemblies 25, 39 descend, the hydrostatic pressure of well fluid 13 increases. Compensator flexible sleeve 69 transmits the hydrostatic pressure of well fluid 13 within outer chamber 73 to buffer fluid 55 in buffer fluid chamber 70. Reducing the pressure differential between well fluid 13 and buffer fluid chamber 70 makes sealing buffer fluid chamber 70 with seal 94, barrier plugs 53 and valve 49 more reliable. At the same time and independently of compensator flexible sleeve 69, bladder 99 in seal section 43 will reduce the pressure differential and preferably equalize the pressure of motor oil 105 with well fluid 13.

The operator will cause controller 51 to supply electrical power to primary pump assembly 25 to pump well fluid through production tree 15 and out flow line 19. Primary pump assembly 25 may operate for months or years while secondary pump assembly 39 remains in a stored, non operating mode. During that time, if well fluid contamination sensor 74 is employed, it will provide signals indicating whether or not leakage of well fluid 13 into buffer fluid chamber 70 has occurred.

Primary pump assembly 25 may eventually fail, or the operator may decide for other reasons to shut down primary pump assembly 25 and begin operating secondary pump assembly 39. If so, hydraulic pump 57 applies sufficient pressure to buffer fluid chamber 70 to expel barrier plugs 53, or some other technique is used to open intake ports 47. The internal increase in pressure in buffer chamber 70 may also cause valve 49 in support device 21 to move to an open position. Controller 51 ceases to supply electrical power to primary pump assembly 25 and begins supplying power to secondary pump assembly 39. Well fluid 13 flows into intake ports 47, displacing buffer fluid 55.

Figure 4:
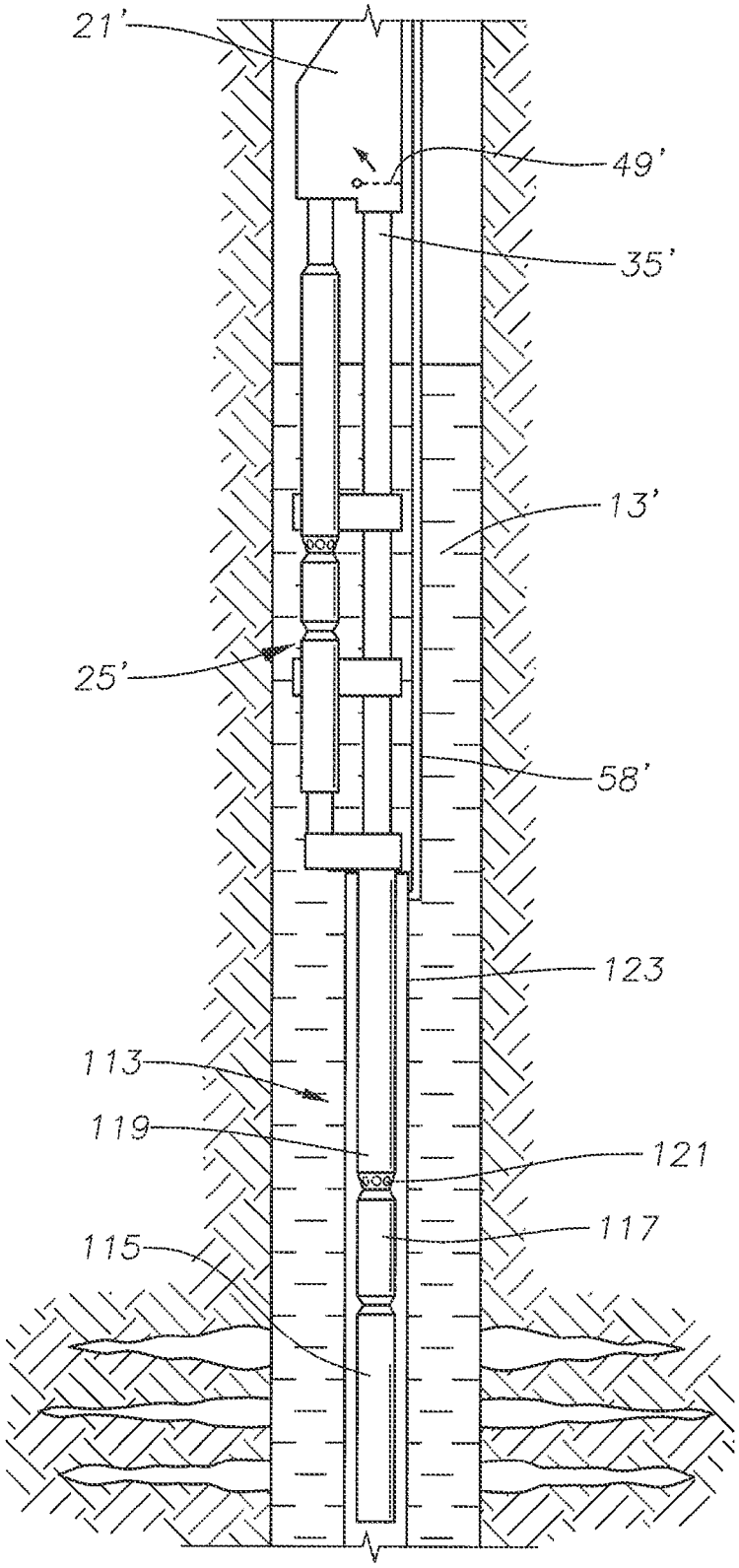
FIG. 4 is a side view, partially sectioned, of an alternate embodiment of well pumping equipment having a buffer fluid pressure compensator.
Figure 5:
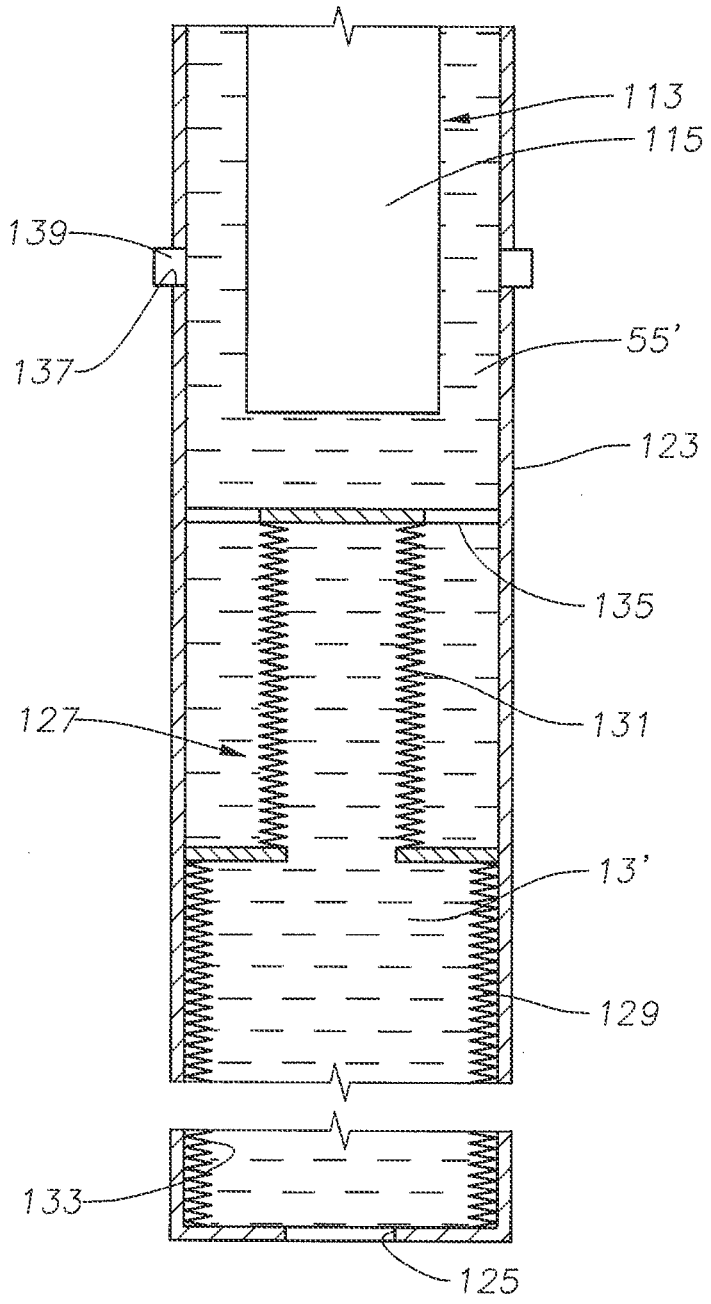
FIG. 5 is a sectional view of a lower portion of the buffer fluid pressure compensator of FIG. 4.

The alternate embodiment of FIGS. 4 and 5 has many components in common, and some of these components are illustrated with the same numerals, except for a prime symbol. Primary submersible pump assembly 25', Y-tool support 21', and flapper valve 49' may be the same as in the first embodiment. Secondary pump assembly 113 has a motor 115 coupled to a seal section 117, which in turn is connected to pump 119. Motor 115, seal section 117, and pump 119 may be the same as those of the first embodiment, except that pump intake ports 121 do not have barriers 53. Pump 119 has a discharge connected to secondary tube 35'.

The pressure compensator for the second embodiment includes a capsule or canister 123 that is mounted to and encloses secondary pump assembly 113. Capsule 123 is a cylindrical tube that may have its upper end sealed and connected to secondary inlet tube 35'. Alternately, the upper end of capsule 123 could be sealed and connected directly to pump 119 at any point above pump intake 121. Delivery tube 58 extends from the surface down to capsule 123.

Referring to FIG. 5, capsule 123 has a well fluid entry or compensation port 125, which is shown on the bottom of capsule 123, but compensation port 125 could be located elsewhere in capsule 123. A flexible sleeve, which is illustrated as a metal bellows 127 is sealingly mounted over well fluid compensation port 125. Bellows 127 could alternately be an elastomeric sleeve or some other type of movable element. Bellows 127 may have a larger diameter section 129 and a smaller diameter section 131. Bellows 127 has an interior 133 that is in fluid communication with well fluid 13' via well fluid 13 compensation port 125. In this example, the upper end 132 of smaller diameter section 131 is connected to a support 135 in capsule 123 to prevent movement of upper end 132. Buffer fluid 55' in capsule 123 communicates above and below support 135 through openings in support 135. Upper end 132 seals well fluid 13' in the interior 133 of bellows 127 from buffer fluid 55' contained in capsule 123.

Capsule 123 has well fluid intake ports 137 for admitting production fluid flow to pump intake 121 (FIG. 4) when secondary pump assembly 113 is in the operational mode. Barriers 139 block well fluid entry through intake ports 137 while secondary pump assembly 113 is in the storage mode. Barriers 139 may be of the same type as discussed above in connection with barriers 53 (FIG. 3).

In operation of the second embodiment, pump intake 121 is left open and secondary pump assembly 113 is installed within capsule 123. Capsule 123 is filled with buffer fluid 55', which also fills secondary pump 119 and a portion of seal section 117. Primary pump assembly 25' and secondary pump assembly 113, including capsule 123, are lowered as an assembly into the well. Well fluid 13' enters bellows 127, and the hydrostatic pressure of the well fluid is transmitted to buffer fluid 55' via the axial movement of larger and smaller diameter portions 129, 131 of bellows 127. The pressure of the buffer fluid 55' within secondary pump 119 and within seal section 117 exterior of the bladder, which is the same as bladder 99 in FIG. 2, will thus be at the well fluid hydrostatic pressure. The bladder in seal section 117 transmits the hydrostatic pressure of the buffer fluid 55' to dielectric oil contained in motor 115.

When it is desired to place secondary pump assembly 113 in operation, barriers 139 are opened or removed. In the example shown, the operator applies fluid pressure via delivery tube 58 to the interior of capsule 123, expelling barriers 139. Turning on motor 115 causes pump 119 to draw well fluid 13' into capsule 123 through intake ports 137, which flows to pump intake 121. Bellows 127 will perform no function while secondary pump assembly 113 is in the operational mode.

While the disclosure has been shown and described in only a few of its forms, it should be apparent to those skilled in the art that it is not so limited but is susceptible to various changes without departing from the scope of the disclosure.

The invention claimed is:

1. An apparatus for pumping well fluid from a well, comprising:

a primary pump assembly and a secondary pump assembly operatively coupled to each other, each of the primary and secondary pump assemblies having a motor filled with a motor oil, a pump with an intake and a seal section having a pressure equalizing element to reduce a pressure difference between the motor oil and well fluid;

the secondary pump assembly having a storage mode while the primary pump operates, the secondary pump having an operational mode allowing flow from the secondary pump assembly;

a buffer fluid sealed within the pump of the secondary pump assembly while the secondary pump assembly is in the storage mode, the buffer fluid also being sealed from the motor oil in the motor of the secondary pump assembly;

a pressure compensator mounted to the secondary pump assembly and having a movable element that moves in response to a difference in pressure between well fluid on an exterior of the secondary pump assembly and buffer fluid within the pump of the secondary pump assembly to reduce a pressure differential between the well fluid and the buffer fluid; wherein the pressure compensator comprises:

a capsule enclosing the motor, the seal section and the pump at a point above the intake of the secondary well pump assembly, the capsule being filled with the buffer fluid that communicates with the buffer fluid in the pump of the secondary well pump assembly, the capsule having a well fluid compensation port;

a flexible sleeve located within the capsule and having an interior in fluid communication with the well fluid compensation port for filling the interior with well fluid, the flexible sleeve sealing the buffer fluid in the capsule from the well fluid contained in the interior of the flexible sleeve;

a pump intake port in the capsule that when open communicates well fluid on an exterior of the capsule with an interior of the capsule exterior of the flexible sleeve; and a barrier in and closing the pump intake port while the secondary pump assembly is in the storage mode, the barrier being configured to open the pump intake port while the secondary pump assembly is in the operational mode.

2. The apparatus according to claim 1, further comprising:

a sensor mounted in the secondary pump assembly in fluid communication with the buffer fluid, the sensor sensing well fluid contamination within the buffer fluid.

3. An apparatus for pumping well fluid from a well, comprising;

a supporting device for positioning within the well;

a primary pump assembly and a secondary pump assembly, each mounted to and supported by the supporting device, the primary pump assembly and the secondary pump assembly each comprising a motor filled with a motor oil, a seal section having a pressure equalizing element to reduce a pressure differential between the motor oil and well fluid on an exterior of the motor, and a pump with a pump intake;

the supporting device having a valve that has a first position allowing flow from the primary pump assembly while the secondary pump assembly is in a storage mode, and a second position allowing flow from the secondary pump assembly;

a barrier for the pump intake of the pump of the secondary pump assembly while the secondary pump assembly is in the storage mode, defining a buffer fluid chamber in the secondary pump sealed from the well fluid, the barrier being configured to open the pump intake to well fluid while the secondary pump assembly is in an operational mode;

a buffer fluid contained within the buffer fluid chamber and sealed from the motor oil in the motor of the secondary pump assembly;

a pressure compensator mounted to the secondary pump assembly and having a movable element that reduces a difference between a pressure of well fluid on an exterior of the secondary pump assembly and a pressure of the buffer fluid in the buffer fluid chamber;

wherein the pressure compensator comprises:

a capsule carried by the supporting device and enclosing the motor, the seal section and the pump to a point above the pump intake of the secondary well pump assembly, the capsule being filled with the buffer fluid that is in fluid communication with the pump intake of the secondary well pump assembly, the capsule having a well fluid compensation port;

a flexible sleeve located within the capsule and having an interior in fluid communication with the well fluid compensation port to admit well fluid into the interior of the flexible sleeve, the flexible sleeve sealing the buffer fluid in the capsule from the well fluid contained in the interior of the flexible sleeve;

a pump intake port in the capsule that when open communicates well fluid on the exterior of the capsule with an interior of the capsule on an exterior of the flexible sleeve; and wherein the barrier is located in and closes the pump intake port while the secondary pump assembly is in the storage mode.

4. The apparatus according to claim 3, further comprising:

a sensor mounted in the secondary pump assembly in fluid communication with the buffer fluid in the buffer fluid chamber, the sensor sensing contamination of the buffer fluid with the well fluid; and a surface panel remotely located from the secondary pump assembly for receiving a signal from the sensor indicating contamination of the buffer fluid with the well fluid.

5. The apparatus according to claim 3, wherein:

the pressure compensator operates independently of the seal section of the secondary pump assembly.

6. An apparatus for pumping well fluid from a well, comprising:

a supporting device for positioning within the well;

a primary pump assembly and a secondary pump assembly, each mounted to and supported by the supporting device;

the secondary pump assembly comprising a motor filled with a motor oil, a motor oil pressure compensator, and a pump with a pump intake;

the supporting device having a valve that has a first position allowing flow from the primary pump assembly while the secondary pump assembly is in a storage mode, and a second position allowing flow from the secondary pump assembly while the secondary pump assembly is in an operating mode;

a capsule enclosing the motor, the motor oil pressure compensator and the pump to a point above the pump intake;

a well fluid pump intake port extending into the capsule to admit well fluid into the capsule while the secondary pump assembly is in the operating mode;

a barrier closing the well fluid pump intake port to block well fluid from flowing into the capsule and into the pump intake while the secondary pump assembly is in the storage mode, the barrier being openable to allow well fluid to flow into the capsule while the secondary pump assembly is in the operating mode;

the capsule and the pump being filled with a buffer fluid while the secondary pump assembly is in the storage mode;

a buffer fluid compensation port extending into the capsule; and a buffer fluid pressure compensator located within the capsule to equalize a pressure differential between the buffer fluid in the capsule and well fluid on an exterior of the capsule, the buffer fluid pressure compensator having an interior in fluid communication with the well fluid compensation port to admit well fluid into the interior of the buffer fluid pressure compensator, the buffer fluid pressure compensator having an exterior in fluid communication with the buffer fluid contained in the capsule while the secondary pump assembly is in the storage mode.

* * * * *